US005922197A

United States Patent [19]

Sparks

[11] Patent Number: 5,922,197

[45] Date of Patent: Jul. 13, 1999

[54] DEBRIS SUPPRESSION DEVICE

[76] Inventor: Gary D. Sparks, 4232 Mulligan Dr., Carson City, Nev. 89701

[21] Appl. No.: 08/892,006

[22] Filed: Jul. 14, 1997

[51] Int. Cl.[6] ..... B01D 35/02

[52] U.S. Cl. ..... 210/232; 210/258; 210/416.1; 210/460

[58] Field of Search ..... 210/232, 258, 210/416.1, 459, 460

[56] References Cited

U.S. PATENT DOCUMENTS

| | | | |
|---|---|---|---|
| 615,847 | 12/1898 | Hansen | 210/460 |
| 704,012 | 7/1902 | Emerson | 210/460 |
| 785,125 | 3/1905 | Shafer | 210/460 |
| 3,206,036 | 9/1965 | Hawley | 210/460 |
| 4,134,174 | 1/1979 | Flynn et al. | 15/302 |
| 4,382,581 | 5/1983 | Wimmer et al. | 254/134.3 FT |

FOREIGN PATENT DOCUMENTS

| | | | |
|---|---|---|---|
| 518541 | 1/1921 | France | 210/460 |
| 442966 | 2/1936 | United Kingdom | 216/460 |

*Primary Examiner*—Peter A. Hruskoci

*Attorney, Agent, or Firm*—Patent Law Firm, P.C.; Peter Jon Gluck; F. Xavier Lojacono

[57] ABSTRACT

A debris suppression device in combination with a manhole on-site remediation system which defines a discharge system having a hose and a pump system to clean out and discharge contaminated and stagnated polluted water that accumulates in manholes and underground vaults, wherein the debris suppression device comprises a submersible bucket formed with a plurality of drain holes located adjacent the opening of the bucket and a plurality of straps which define strut members that are fixedly mounted to the bucket and extend upwardly so as to be secured to the flexible hose, whereby solid materials of various sizes and shapes found in stagnated polluted water are prevented from being pumped or discharged through the remediation system.

10 Claims, 1 Drawing Sheet

DEBRIS SUPPRESSION DEVICE

BACKGROUND 0F THE INVENTION

1. Field of the Invention

This invention relates generally to a device for draining fluids and more particularly to a debris suppression device that includes a submersible bucket formed with a plurality of drain holes located adjacent the opening of the bucket and a plurality of straps which define strut members fixedly mounted to the bucket and extending upwardly so as to be secured to a flexible hose or pump body by means of an adjustable hose clamp.

2. Description of the Prior Art

As is well known in the art various problems and difficulties are incurred when a water draining operation takes place under conditions wherein contaminated debris is present in the water. This is a particular problem when there is a need to drain water or fluids in a utility company facility or when anyone needs to enter a manhole or underground vault for access to a waste system or storm drain.

It has been found that most underground water is good or uncontaminated but that construction debris at the bottom is normally bad or contaminated and fouls the water. Therefore, the bucket of the present invention is used to pump the uncontaminated water down to the construction debris so that normal work functions may be performed.

Generally a remediation system is employed to safely and expediently drain or discharge many types of liquid contents from confined areas or vaults, particularly those that are often found underground.The liquid is generally stagnated water in which contaminated material and debris may be found.

As an example of a remediation system, there is a four-stage device featuring individual filters that remove particulates, petroleum hydrocarbons, copper and lead. This system is an adaptation of safe-industry technology currently used today. The base system includes four filter stages and a dewatering pump that pressurizes and operates the system. This system is adapted to be mounted on skids or a trailer to provide a flexible unit that can be operated under many different conditions and in various locations.

When a remediation system of this type is to be operated, prior testing is performed to determine which pollutants present in the water need to be removed and discharged in or to a environmentally safe area. This allows the operator to adjust and select the appropriate filters on the manifold to separate lead, hydrocarbons, copper or particulates as the contaminated water passes through the system.

However, there is still a need for a simple device that prevents debris containing solid materials of all sizes and shapes from entering the system. While test research has shown that the majority of water in underground vaults is safe to discharge into storm drains, the opposite is often true for debris found at the bottom of a vault. When an inlet hose or submersible pump is placed in a vault, the kinetic action of pumping agitates the settled debris and suspends some of it in the discharging water. It follows that if the debris is polluted, and enters the pump, the water then also becomes polluted. Thus, there is at the present time a great need for a simple device that can be readily attached to the free end of a pump hose to prevent the polluted debris from reaching the pump of the system and being discharged or fouling the pump.

OBJECTS AND ADVANTAGES OF THE INVENTION

Accordingly, it is an important object of the present invention to provide a debris suppression device that overcomes the existing problems in the industry when solid materials are found in stagnated water accumulated in manholes and various types of underground vaults. Large objects can now be prevented from entering a suction hose to cause considerable breakdown within the remediation system.

Another object of the present invention is to provide a debris suppression device defined by an enlarged bucket unit that includes a support and clamping device for mounting the bucket to a suction hose or a submersible pump.

Still another object of the invention is to provide a debris suppression device that is simple to operate, has relatively few operating parts, and is rugged in construction.

A further object of the invention is to provide a debris suppression device of this character that is relatively inexpensive to manufacture, and easy to service and maintain.

It may thus be seen that the objects of the present invention set forth herein, as well as those made apparent from the foregoing description, are efficiently attained. While the preferred embodiment of the invention has been set forth for purpose of disclosure, modifications of the disclosed embodiment of the invention as well as other embodiments may occur to those skilled in the art.

BRIEF DESCRIPTION OF THE DRAWINGS

The objects and features of the present invention will be further understood with reference to the following detailed description of the illustrated embodiment of the invention, taken together with the accompanying drawings in which.

DESCRIPTION OF THE PREFERRED EMBODIMENT

Figure 1:
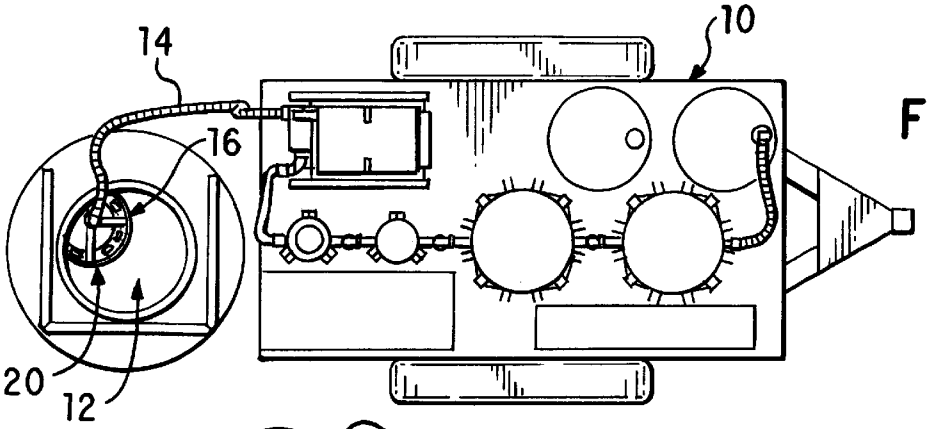
FIG. 1 is a top plan view schematically illustrating an on-site manhole remediation system mounted on a trailer and showing the debris suppression bucket lowered in a manhole.

Referring to the drawings and more particularly to the schematic view of FIG. 1, there is illustrated a manhole on-site remediation system, generally indicated at 10, which is shown as being mounted on a trailer so as to be transportable. The system of this kind is used for draining contaminated liquids such as water commonly found in manholes, as indicated generally at 12, or similar underground vaults. As previously described, this water has a large quantity of debris that settles at the bottom which can not to be allowed to pass through the drain hose 14, also referred to as the discharge hose, since large pieces of material and debris will clog the system and cause damage to any one of the functional elements.

In FIG. 1, the present invention is shown being located in an underground vault 12 in which it is being used as a debris suppression means, generally designated at 16, which is securely affixed to the suction end of hose 14. The debris suppression means is constructed in such a manner as to prevent large pieces of debris from gaining entrance to the system, as will hereinafter be described in more detail.

Figure 3:
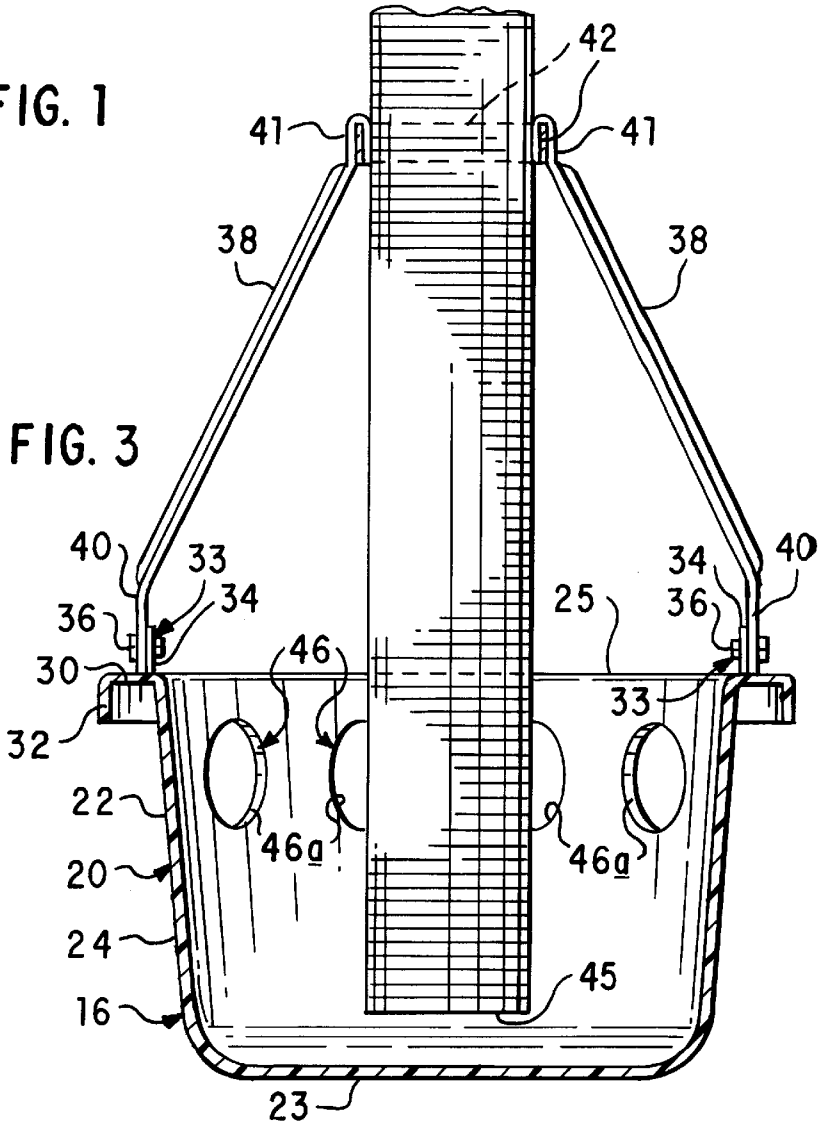
FIG. 3 is an enlarged cross-sectional view of the bucket taken substantially along line 3—3 of FIG. 1.

Accordingly, the debris suppression device 16 comprises a bucket or a suitable container 20 which is formed having a diameter between 10 to 20 inches, but the preferred diameter being approximately 17 inches or more-and with a suitable height of at least 9 inches or more. The bucket is constructed from a suitable metal reinforced with rubber or plastic material that is substantially designed to resist abrasions and to withstand most types of destructive chemicals that might be present in particular stagnated waters. Although other suitable configurations can be employed bucket 20 is formed preferably with a circular body member 22, wherein the bucket or container is defined by a bottom wall 23 and an inclined annular wall 24. The upper peripheral edge 25 of the annular wall 24 is formed to define an annular inverse channel 26 which establishes the upper opening 28 of the bucket 20. Channel 26 is defined by the upper edge 25 of wall 24 that is bent outwardly, providing a substantially flat shoulder 30 on which is formed an integrally depending flange member 32, as shown in FIG. 3. This arrangement provides a very sturdy bucket that will not very readily collapse and lose its shape.

Figure 2:
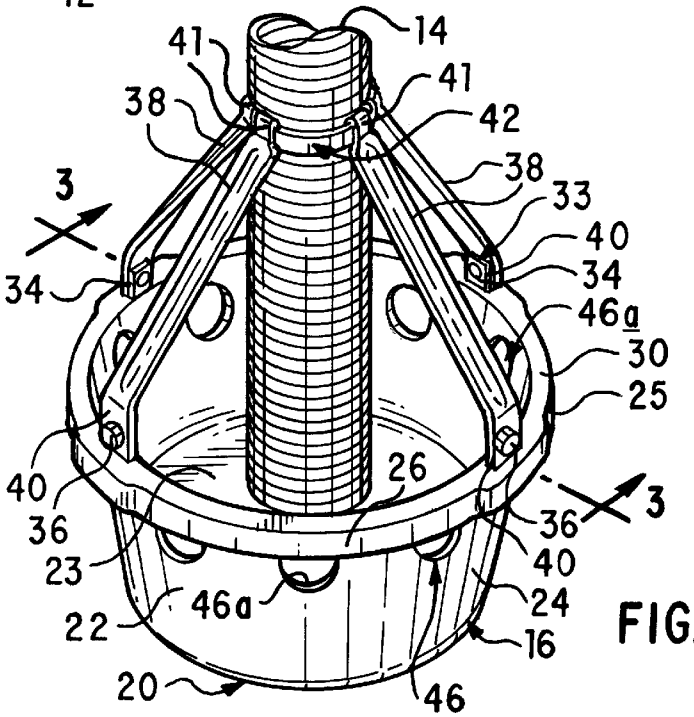
FIG. 2 is a perspective view of the invention defining a debris suppression device showing the device attached to the end portion of a suction hose.

This sturdy structure allows the bucket to include bracket means, generally indicated at 33, defined as a plurality of upwardly extended ear members 34 formed therein which are equally spaced about channel 26. These ear members 34 can be made from metal strips formed in the bucket or as separate members that are integrally secured thereto. The preferred form of the bucket includes at least four ear members 34, each being adapted to receive a bolt 36 for fixedly attaching a metal strap that defines a strut member 38 which supports bucket 20 when secured to a suitable hose 14. On each member 38 there is formed at its lower end a flat extended lip member 40 adapted with a hole to also receive bolt 36, whereby each strut member 38 can be readily secured to each respective lip member 40, as illustrated in FIGS. 2 and 3, so that together they define a securing means.

The opposite upper end of each strut 38 is formed with a suitable keeper means defined by a hook 41 formed so as to be mounted to a suitable clamping means, designated at 42, shown as a typical adjustable hose clamp. The size of the clamp will be determined by the diameter of the hose or pump which can be any size between 2 to 12 inches.

Research has indicated that the majority of water in underground vaults is safe to discharge into storm drains. However, the opposite is often true when damaging environmentally polluted debris is found in the bottom of manholes and vaults. When an inlet hose or submersible pump is placed in a manhole or vault, the kinetic action of pumping agitates the settled debris and suspends some of it in the discharging water, allowing the polluted debris to enter the pump. However, the particular arrangement of bucket 20 of the present invention prevents the settled sludge, large objects and other debris in the water from entering the discharge system, because mouth 45 of hose 14 is positioned in close proximity to bottom wall 23 well below a restraining means 46 formed in the annular side wall 24 of the bucket 20. Restraining means 46 comprises a plurality of holes 46*a* formed in the annular wall 24, each hole having a two-inch diameter opening.

Consequently, during the water discharging operation the hose 14 sucks and removes all the water above the holes in the bucket 20 which are located just below channel 26. Therefore, the settled debris is not disturbed and only water flows through the draining system or submergible pump. Once the water has been removed all large debris is also removed.

The foregoing should only be considered as illustrative of the principles of the invention. Further, since numerous modifications and changes may readily occur to those skilled in the art, it is not desired to limit the invention to the exact construction and operation as shown and described, and accordingly, all suitable modifications and equivalents may be resorted to, falling within the scope of the claimed invention.

What I claim is:

1. A debris suppression device attached to a discharge system that includes a base and a hose and a pump so as to prevent debris or solid materials of various sizes and shapes found in stagnated polluted water that accumulates in manholes and underground vaults from being pumped or discharged in a clean environment or clogging the hose and damaging the discharge system, wherein the device comprises:

a submersible bucket formed having an annular wall a bottom wall, and an annular reinforced edge, whereby an opening of said bucket is defined;

a plurality of equally spaced drain holes disposed in said annular wall and located below said annular reinforced edge of said bucket;

means for securing said bucket adjacent the terminal end of the hose of the discharge system, whereby said bucket is lowered and positioned into the polluted water;

wherein said means for securing said bucket comprises:

a plurality of support straps, each including an upper securing end and a lower securing end;

a clamping means fixedly mounted to the hose, wherein said upper securing end of said support strap is attached thereto; and bracket means mounted to said annular reinforced edge of said bucket and equally spaced apart thereon, and whereby said lower securing end of each of said straps is secured thereto.

2. A debris suppression device attached to a discharge system that includes a base and a hose and a pump so as to prevent debris or solid materials of various sizes and shapes found in stagnated polluted water that accumulates in manholes and underground vaults from being pumped or discharged in a clean environment or clogging the hose and damaging the discharge system, wherein the device comprises:

a submersible bucket formed having an annular wall, a bottom wall, and an annular reinforced edge, whereby an opening of said bucket is defined;

a plurality of equally spaced drain holes disposed in said annular wall and located below said annular reinforced edge of said bucket;

means for securing said bucket adjacent the terminal end of the hose of the discharge system, whereby said bucket is lowered and positioned into the polluted water;

wherein said means for securing said bucket comprises:

a plurality of support straps, each including an upper securing end and a lower securing end;

a clamping means fixedly mounted to the hose, wherein said upper securing end of said support strap is attached thereto; and bracket means mounted to said annular reinforced edge of said bucket and equally spaced apart thereon, and whereby said lower securing end of each of said straps is secured thereto;

wherein said support straps define a plurality of strut members interposed between said bucket and said clamping means.

3. A debris suppression device attached to a discharge system that includes a base and a hose and a pump so as to prevent debris or solid materials of various sizes and shapes found in stagnated polluted water that accumulates in manholes and underground vaults from being pumped or discharged in a clean environment or clogging the hose and damaging the discharge system, wherein the device comprises:

a submersible bucket formed having an annular wall, a bottom wall, and an annular reinforced edge, whereby an opening of said bucket is defined;

a plurality of equally spaced drain holes disposed in said annular wall and located below said annular reinforced edge of said bucket;

means for securing said bucket adjacent the terminal end of the hose of the discharge system, whereby said bucket is lowered and positioned into the polluted water;

wherein said means for securing said bucket comprises:

a plurality of support straps, each including an upper securing end and a lower securing end;

a clamping means fixedly mounted to the hose, wherein said upper securing end of said support strap is attached thereto; and bracket means mounted to said annular reinforced edge of said bucket and equally spaced apart thereon, and whereby said lower securing end of each of said straps is secured thereto;

wherein said support straps define a plurality of strut members interposed between said bucket and said clamping means;

wherein said clamping means comprises an adjustable strap and wherein, said upper securing end of each of said strut members is formed having a hook bent to be received over said strap member.

4. A debris suppression device as recited in claim 3, wherein said annular reinforced edge defines an inverted channel member having a substantially annular flat shoulder formed with an integral depending flange member.

5. A debris suppression device as recited in claim 4, wherein said bracket means is defined by a plurality of vertically disposed ear members mounted to said annular flat shoulder of said bucket, and arranged to be secured to said respective lower end of each of said strut members, and wherein said lower ends are defined as extended lip members arranged to be secured to said ear members.

6. In combination, a manhole on-site remediation system and a debris suppression device, wherein the combination comprises:

a manhole on-site remediation system which defines a discharge system including a hose and a pump to flush out and discharge contaminated and stagnated polluted water that accumulates in manholes and underground vaults;

a submersible bucket formed having an annular wall, a bottom wall, and an annular reinforced edge, whereby an opening of said bucket is defined;

a debris suppression device comprising:

a plurality of equally spaced drain holes disposed in said annular wall and located below said annular reinforced edge of said bucket; and means for securing said bucket adjacent the terminal end of said hose of said discharge system, whereby said bucket is lowered and positioned into said polluted water;

wherein said means for securing said bucket comprises:

a plurality of support straps, each including an upper securing end and a lower securing end;

a clamping means fixedly mounted to said hose, wherein said upper securing end of each of said support straps is attached thereto; and bracket means mounted to said annular reinforced edge of said bucket and equally spaced apart thereon, and whereby said lower securing end of each of said straps is secured thereto.

7. The combination as recited in claim 6, wherein said support straps define a plurality of strut members interposed between said bucket and said clamping means.

8. The combination as recited in claim 6, wherein said clamping means comprises an adjustable strap and wherein each of said upper securing ends of said strut members is formed having a hook bent to be received over said strap member.

9. The combination as recited in claim 6, wherein said annular reinforced edge defines an inverted channel member having a substantially annular flat shoulder formed with an integral depending flange member.

10. The combination as recited in claim 6, wherein said bracket means is defined by a plurality of vertically disposed ear members mounted to said annular flat shoulder of said bucket and arranged to be secured to said respective lower ends of said strut members, and wherein said lower ends are defined as extended lip members arranged to be secured to ear members.

* * * * *